US007426920B1

(12) United States Patent
Petersen

(10) Patent No.: US 7,426,920 B1
(45) Date of Patent: Sep. 23, 2008

(54) FUEL MIXER APPARATUS AND METHOD

(75) Inventor: Peter Petersen, Carlsbad, CA (US)

(73) Assignee: Omnitek Engineering Corp., San Marcos, CA (US)

( * ) Notice: Subject to any disclaimer, the term of this patent is extended or adjusted under 35 U.S.C. 154(b) by 0 days.

(21) Appl. No.: 11/810,620

(22) Filed: Jun. 6, 2007

(51) Int. Cl.
*F02B 43/02* (2006.01)
*F02B 43/00* (2006.01)

(52) U.S. Cl. ..... 123/527; 123/525

(58) Field of Classification Search ..... 123/527, 123/525, 526, 590, 592, 593, 27 GE
See application file for complete search history.

(56) References Cited

U.S. PATENT DOCUMENTS 1,012,380 A * 12/1911 Loose ..... 123/590
4,063,905 A 12/1977 Johnson et al.
4,149,562 A 4/1979 Johnson et al.
4,153,028 A * 5/1979 Kumm et al. ..... 48/189.5
4,399,795 A 8/1983 Brown
4,478,607 A * 10/1984 Capps ..... 48/189
4,479,466 A * 10/1984 Greenway et al. ..... 123/527
4,494,515 A 1/1985 Brown
4,520,783 A 6/1985 Matsushita et al.
4,872,440 A * 10/1989 Green ..... 123/590
5,245,977 A 9/1993 Chen et al.
5,377,646 A 1/1995 Chasteen
5,408,978 A 4/1995 Davis
5,551,407 A 9/1996 Greenway
5,673,673 A 10/1997 Beck
5,881,701 A 3/1999 King
5,908,475 A 6/1999 Morris, Jr. et al.
6,131,552 A 10/2000 Paielli et al.
6,742,771 B2 6/2004 Bayer et al.

OTHER PUBLICATIONS

Continetal Controls Corporation, Emissions Control System ECV5,Jun. 26, 2004, 4 pages, San Diego, California.
Taltronic Controls, Inc., Operate your diesel engine on natural gas, Jul. 27, 2004, 2 pages, Weston, Florida.
Continetal Controls Corporation, Mixing Venturi VM-350, Jul. 27, 2004, 3 pages, San Diego, California.

* cited by examiner

*Primary Examiner*—Mahmoud Gimie

(57) ABSTRACT

An apparatus to deliver a fuel into a chamber is provided. In one embodiment, the apparatus includes a fuel inlet and a substantially circular fuel distribution canal communicating with the fuel inlet. A biasing element is coupled to the substantially circular fuel distribution canal, with the biasing element having a plurality of slots arranged to non-uniformly dispense the fuel into the chamber. Another embodiment includes a flange positioned in the substantially circular fuel canal, with the flange structured to perturb a fuel passing into the chamber. This Abstract is provided for the sole purpose of complying with the Abstract requirement rules that allow a reader to quickly ascertain the subject matter of the disclosure contained herein. This Abstract is submitted with the explicit understanding that it will not be used to interpret or to limit the scope or the meaning of the claims.

14 Claims, 5 Drawing Sheets

FUEL MIXER APPARATUS AND METHOD

FIELD OF THE INVENTION

The present invention generally relates to internal combustion engines. More particularly, the invention concerns a method and apparatus to mix air and fuel in an internal combustion engine.

BACKGROUND OF THE INVENTION

Spark ignition engines that employ single or multipoint fuel metering concepts rely upon a throttle body to proportion the air flow rate in response to the operators commanded power level. Simply put, the more air flow allowed into the engine, the higher the power output. For most engines, the operator commands power via the foot pedal which either directly moves the throttle plate through an intermediate cable, or indirectly with a drive-by-wire throttle. In either case, the fuel management system adds the correct amount of fuel as required by the commanded airflow to achieve a desired air-to-fuel ratio (AFR).

As an engine is driven though different speeds and loads, the fuel management system calculates and delivers the ideal amount of fuel in proportion to the airflow to both maximize performance and minimize emissions. Of course, control of the air-fuel ratio is an important part of engine performance and emissions minimization. However, there are several common problems exhibited by internal combustion engines that tend to disturb the AFR.

In an ideal situation, the same ratio of air and fuel are introduced into each cylinder and in a mixed form, or in other words, in the form of a homogeneous charge. This results in a power balanced engine with excellent emission characteristics. In the real world, air flow balance from cylinder to cylinder is achieved only with significant intake system development. Intake system development is extensive for automotive engines utilizing multipoint injection, but intake systems on medium and heavy duty engines are generally neglected. This is especially true for diesel engines because diesel engines operate with excess air in the combustion chamber, so small variations in the air flow from cylinder to cylinder are not critical to achieving good emissions. However, when a diesel engine is converted to a gaseous fuel, the intake system becomes more important.

On the fuel side of the equation, carburetors have provided limited performance and can meet older emission standards, however it should be noted that no carbureted engines are currently sold in the United States, as they simply will not pass current emission standards. Next is the single-point metering concept, where typically two fuel injectors are mounted in a throttle body and perform basically like an electronic carburetor. Again, this type of a system has difficulty meeting current emissions levels. The current state of the art is the multipoint injection system where one injector is used per cylinder. When coupled with an engine with an intake system that has been air flow balanced, the system is capable of meeting the most stringent emissions standards.

Unfortunately, the multipoint system which has worked so well for gasoline engines is not a good solution for a diesel engine converted to natural gas. Therefore, there remains a need to overcome one or more of the limitations in the above-described, existing art.

Figure 1:
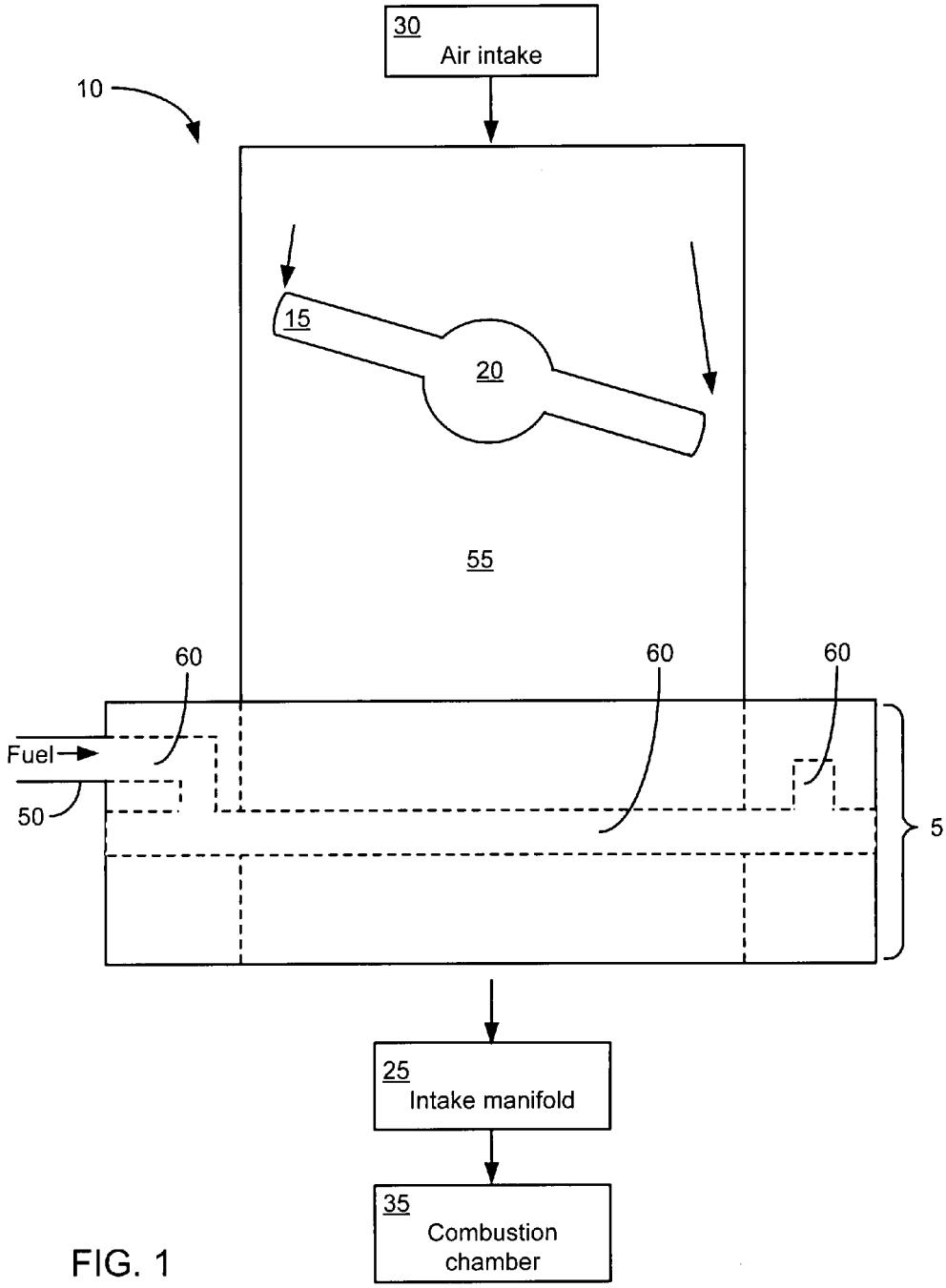
FIG. 1 is a plan view of the fuel mixer coupled to a throttle body.

It will be recognized that some or all of the Figures are schematic representations for purposes of illustration and do not necessarily depict the actual relative sizes or locations of the elements shown. The Figures are provided for the purpose of illustrating one or more embodiments of the invention with the explicit understanding that they will not be used to limit the scope or the meaning of the claims.

DETAILED DESCRIPTION OF THE PREFERRED EMBODIMENTS

In the following paragraphs, the fuel mixer will be described in detail by way of example with reference to the attached drawings. While the fuel mixer is capable of embodiment in many different forms, there is shown in the drawings and will herein be described in detail specific embodiments, with the understanding that the present disclosure is to be considered as an example of the principles of the fuel mixer and not intended to limit the invention to the specific embodiments shown and described. That is, throughout this description, the embodiments and examples shown should be considered as exemplars, rather than as limitations on the fuel mixer. As used herein, the "fuel mixer" to any one of the embodiments of the invention described herein, and any equivalents. Furthermore, reference to various feature(s) of the "fuel mixer" throughout this document does not mean that all claimed embodiments or methods must include the referenced feature(s).

Specific embodiments of the fuel mixer 5, illustrated in FIGS. 1-5 will now be further described by the following, non-limiting examples which will serve to illustrate various features. The examples are intended merely to facilitate an understanding of ways in which the fuel mixer 5 may be practiced and to further enable those of skill in the art to practice the invention. Accordingly, the examples should not be construed as limiting the scope of the fuel mixer 5.

The fuel mixer 5 described herein is a device which allows the addition, or injection of natural gas, hydrogen, propane, acetylene or another fuel, which may be in a gaseous state, into a stream or sample of air that is ultimately combusted in an internal combustion engine (IC Engine). The fuel mixer 5 mixes the air and gas such that low, or ideal emission levels are attainable. One feature of the fuel mixer 5 is that the mixing occurs downstream of the throttle plate 15. This positioning results in a very simple installation, or retrofit of an existing gaseous metering system, and provides very good results at a low cost.

One feature of the fuel mixer 5 is that it enables the conversion of diesel engines, that usually combust diesel fuel, to instead combust natural gas fuel, at a cost that is significantly lower than previously possible. In addition, due to the enhanced mixing or blending of the air and natural gas fuel, and engine containing the fuel mixer 5 generates good emission levels. Furthermore, the fuel mixer 5 provides a more robust and simple design that minimizes any mechanical problems. Finally, different embodiments of the fuel mixer 5 having different radii, slot or nozzle configurations, sizes, and/or arrangements is adaptable to almost any engine, with a few different embodiments covering a wide range of different engine models, or types. This minimizes production cost, and also reduces the number of inventoried parts.

Referring now to FIG. 1, the air intake system for an internal combustion engine includes a throttle body 10 that includes a throttle plate 15 that rotates about a throttle pin or shaft 20. As is well known to those skilled in the art of internal combustion engines, a throttle body 10 comprises a housing (usually having a substantially circular cross-section) containing a valve, or throttle plate 15 to regulate air flowing from an air intake 30 through a chamber or air channel 55 into the intake manifold 25 and then into each cylinder's combustion chamber (not shown). The throttle body 10 is usually located between the air intake 30 and the intake manifold 25, and the air channel 55 may be considered to comprise part of, all of, or a portion of, the path from the air intake 30 to the combustion chamber 35 that is taken by the air (and fuel, once it is introduced into the air channel).

Air that is either at ambient pressure, or pressurized above ambient by a supercharger or turbocharger, and which may or may not have passed through an air filter enters the throttle body 10 and the amount, or mass of air allowed to pass through the throttle body 10 is regulated by the throttle plate 15 which is controlled by the operator, usually by a cable or electronically. The throttle plate 15 rotates about the shaft 20, and a larger mass or flow of air tends to pass around one side of the throttle plate 15 than the other, as shown by the larger and smaller arrows in FIG. 1, respectively. Generally, this is due to the momentum effects of the air and the biasing effect of the throttle plate 15. Additionally, no air flow passes around the throttle body 10 where the shaft 20 mounts to the throttle body 10. Clearly, airflow through the air channel 55 is uneven, or irregular.

Due to the uneven flow of air through the throttle body 10 downstream of the throttle plate 15, conventional fuel-air mixers do not work well downstream of the throttle body 10. "Downstream" is defined as a location in the air channel 55 that is between the throttle plate 15 and the combustion chamber 35, and "upstream" is defined as a location in the air channel 55 that is between the air intake 30 and the throttle plate 15, as shown in FIG. 1. Conventional mixers typically provide a fuel flow that is axial-symmetric (i.e. fuel or gas is introduced equally around the perimeter of the throttle body 10). Thus, the gas or fuel entering the air stream is uniform around the perimeter of the throttle body 10, but due to the throttle plate 15, and shaft 20, the air flow downstream of the throttle plate 15 is not uniform. The result is that areas within the throttle body 10 and areas within the remaining downstream intake system (such as the tubing connecting the throttle body 10 to the intake manifold, and the intake manifold itself) are rich (contain extra fuel) while others are lean (not enough fuel).

This stratified, or unequal charge of air and fuel is a result of the throttle plate 15 angle as well as the shaft 20. The amount of stratification, or unevenness of the air-fuel mixture changes with throttle plate 15 angle, or "openness", with a substantially closed throttle plate 15 corresponding to the highest level of stratification while a substantially "wide-open" throttle plate 15 results in the best available mixture, and least stratification, of air and fuel. FIG. 1 illustrates the throttle plate 15 in a substantially "closed" position (blocking a majority of the interior passage of the throttle body 10) while an open position has the throttle plate 15 substantially parallel to the direction of air flow (maximizing air flow through the throttle body 10). Therefore, an ideal method for introducing fuel downstream of the throttle plate 15 generally requires an adjustment, or fine-tuning of the location(s) of fuel introduction in response to the uneven air flow caused by the throttle plate 15 and shaft 20. However, conventional methods do not account for this disruption in air flow, and simply introduce the fuel in a uniform fashion.

However, engine designers have built multipoint fuel injection systems to provide uniform gas flow directly to each engine's cylinder. As pointed out above, while this works with engines designed for multipoint gasoline injection, it does not work for most medium or heavy-duty engines because the air flow to each cylinder in not uniform. These problems have plagued the natural gas engine industry and resulted in poor air-to-fuel ratio ("AFR") control. AFR that differs from cylinder to cylinder can cause premature engine failure, detonation, poor performance and inconsistent emission levels and are responsible for the myth that engines fueled by natural gas are unreliable and produce high emissions that increase air pollution.

In addition, once the gas and air are mixed, it is an explosive mixture ready to be ignited. Backfires do occur. The severity of the backfire is determined by the total volume of air and fuel contained within the intake system. Multipoint injected systems have the least combustible mixture in the intake system because the injector is only injecting while the engine is drawing the mixture into the cylinder. This is not the case for carbureted and single-point injection systems. Here there is a volume of air and fuel ready to be ignited and the total volume of the air-fuel mixture is greater for systems that introduce the fuel upstream of the throttle body 10.

Moreover, regarding pollutant emission levels, generally, the farther the fuel introduction device is away from the air intake valve in each of the engine's cylinders, the slower the engine responds to inputs that require changes to the ideal air-to-fuel ratio ("AFR"). For example, every movement of the gas or throttle pedal by the operator causes a commensurate change in the position of the throttle plate 15, and hence air flow, requiring a change in the amount of fuel, but a system with a large volume is slow to respond to throttle changes. Put differently, the actual AFR lags the ideal AFR. The magnitude of this response lag directly correlates to higher pollutant emission levels. Thus, the ideal situation is to have the fuel introduction device, or metering system as close to each cylinder's intake valve as possible.

Also, gaseous fuels (such as natural gas or hydrogen), as compared to a liquid fuel such as gasoline or diesel, when introduced into an air stream were initially thought to mix readily with the air to achieve a homogeneous mixture. However, this is not the case, and after much research and development a single point metering, or fuel introduction approach is now usually employed in an attempt to provide adequate mixing.

However, among the several shortcomings of conventional devices that provide axially symmetric flow of natural gas or other gaseous fuels into the air stream, all of them are installed upstream of the throttle body 10. The rationale is that additional mixing of the air and fuel occurs as it passes the throttle plate 15. These conventional devices installed downstream of the throttle body 10 do not provide adequate mixing over the engine's entire operating range. For example, many systems for turbocharged engines introduce the fuel just before the turbocharger's compressor to provide additional mixing, but backfires are a significant problem with these engines.

The fuel mixer 5 described herein provides a solution to all of the above-described problems. The fuel mixer 5 allows the gas, or fuel to be mixed with the air downstream of the throttle plate 15. By introducing fuel downstream of the throttle plate 15, the fuel system has better response than any conventional system that introduces fuel upstream of the throttle plate 15 and the volume of mixed fuel and air is minimized, thereby reducing the risk of backfires. In addition, the fuel mixer 5 introduces fuel non-symmetrically to account for the non-uniform flow of air downstream of the throttle plate 15.

Figure 2:
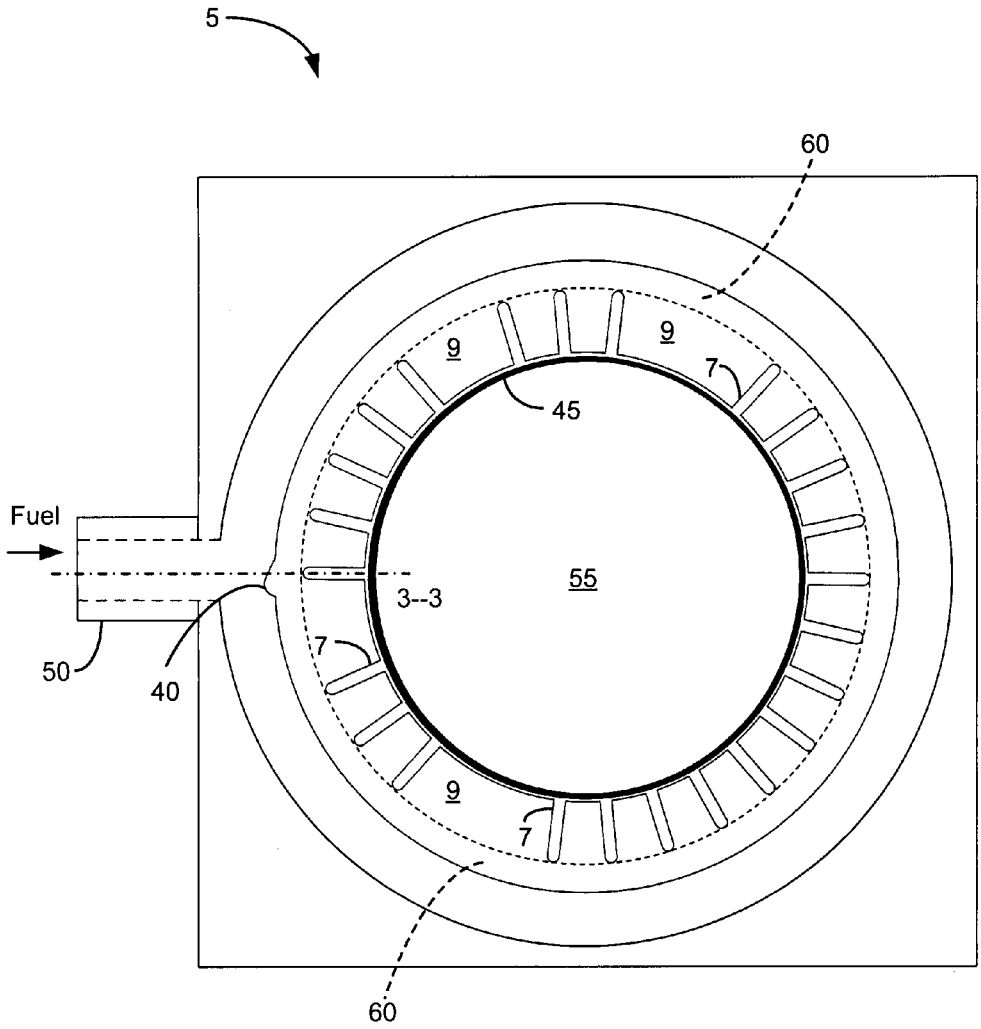
FIG. 2 is an end view of the fuel mixer of FIG. 1, as viewed from the intake manifold side of the fuel mixer.

As shown in FIG. 1, the fuel mixer 5 is located downstream of the throttle plate 15, and may either be attached to the end of the throttle body 10, or preferably, is attached to the intake manifold 25, by fasteners or other suitable means. Gaseous fuel, such as natural gas or hydrogen, or another type fuel enters through port 50, as shown in FIGS. 1 and 2. A fuel canal 60 that is substantially circular, or annular distributes fuel completely around the perimeter of the air channel 55.

Figure 3:
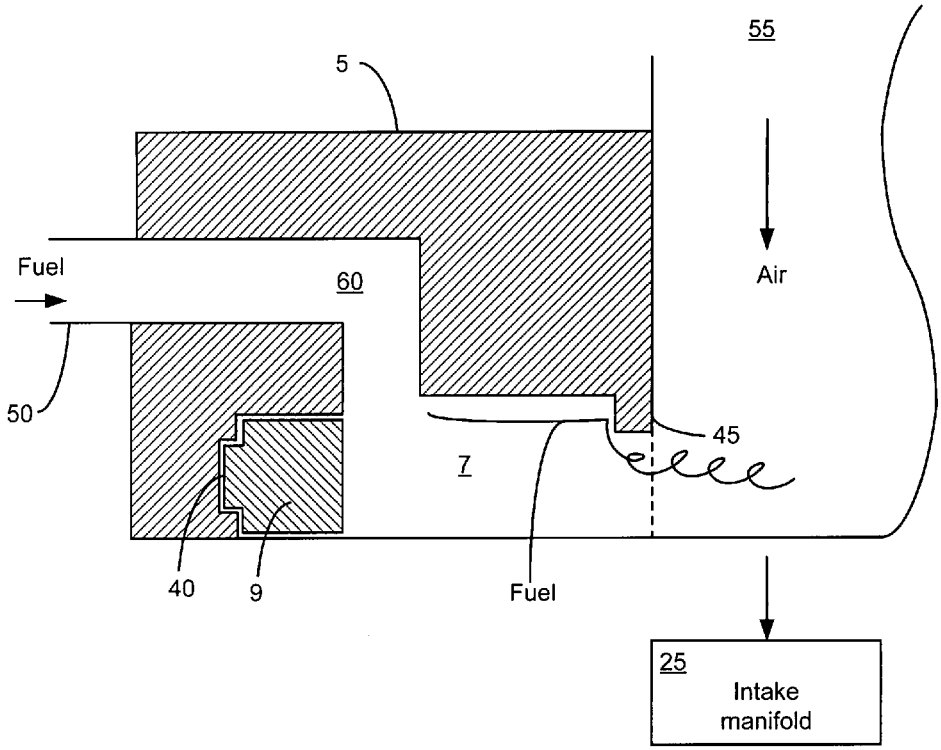
FIG. 3 is a sectional view of the fuel mixer taken along cutting plane 3-3 of FIG. 2.
Figure 4:
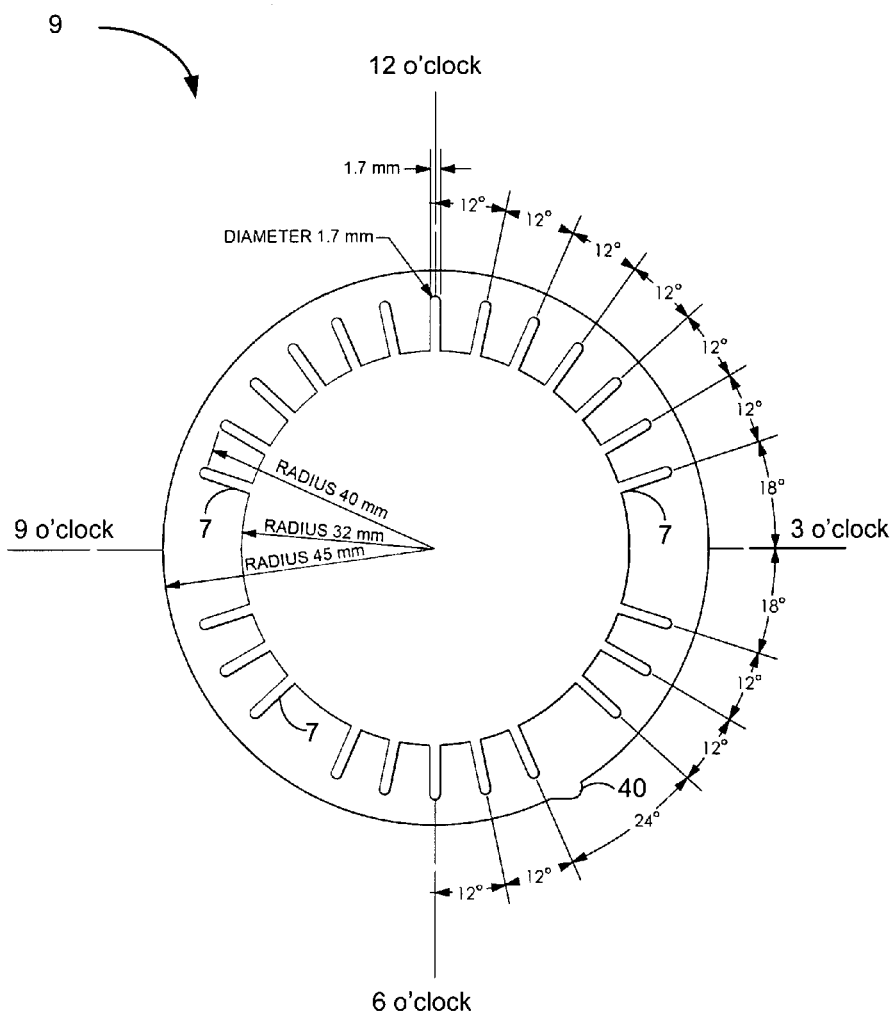
FIG. 4 is a plan view of the biasing element illustrated in FIG. 2.

Fuel is then introduced into the air channel 55 through a plurality of slots 7 that are located in biasing element 9, both of which are illustrated in FIGS. 2-4. The fuel, or metering slots 7 cut in the biasing element 9 only allow fuel to enter the air chamber 55 at specific pre-determined points. In this way, the fuel system designer is free to bias, or "tune" the fuel flow around the internal periphery of the air channel 55 to offset the air flow bias resulting from the throttle plate 15, shaft 20 and other factors, as described above. That is, other embodiments of the biasing element may change the location of the metering slots 7 to tune the location of fuel introduction for each different throttle body 10. Put differently, one feature of the biasing element 9 is that it is "tuned" for each different application, thereby enabling each different engine to have an ideal air-to-fuel ratio.

As shown in FIGS. 2 and 4, the biasing element 9 comprises a generally disk-like, or ring-like shape with several gas metering slots 7 placed in specific locations around the biasing element 9. In one embodiment, the biasing element 9 may also include a positioning tab 40, shown in FIGS. 2-4 that locates the orientation of the gas metering slots 7 for the ideal "tuned" introduction of fuel as described above. In one embodiment, the fuel mixer 5 includes an area sized to receive the positioning tab 40, as shown in FIG. 3, where the positioning tab 40 fits into an appropriately sized area in the fuel mixer 5.

The biasing element 9 may also function as a gasket to seal the interface between the fuel mixer 5 and the throttle body 10. In one embodiment, the biasing element 9 may be made of a compressed aramid/Buna-N sheet gasket material, but any suitable gasket material, such as brass, aluminum, copper, other alloys, paper, rubber, silicone, polymers, plastics, polyesters, neoprenes, Ethylene Propylene Diamine Monomers (EPDMs) or other suitable materials may be employed.

As shown in FIG. 4, in one embodiment the biasing element 9 may have an outer radius of 45 millimeters (mm) with an inner radius of 32 mm, with each slot 7 having a length of 8 mm, and a width of 1.7 mm. In the illustrated embodiment, the slots 7 are located in groups, with each slot 12 degrees apart, separated by gaps of 36 degrees and 24 degrees (as measured using 360 degrees to describe the circumference of the biasing element 9). This non-symmetric arrangement of slots 7 tunes the introduction of fuel as it accounts for the location of the throttle plate shaft 20, as well as the rotational direction of the throttle plate 15. For example, as shown in FIG. 1, when the throttle plate 15 is in the position shown, most of the air passing through the air channel 55 is biased toward the "downstream pointing" end of the throttle plate 15, as shown by the large arrow. Thus, most of the slots 7 are arranged on that side of the air channel 55, as shown by the grouping of slots 7 in FIG. 4 (located from 10 o'clock to 2 o'clock, with the width dimension of 1.7 mm as the 12 o'clock position). No slots 7 are located from 8 to the 10 o'clock position, nor are any slots 7 located from the 2 to 4 o'clock position, which is where the throttle plate shaft 20 attaches to the throttle body 10. Also, a smaller number of slots 7 are located in the 4 to 8 o'clock location, as this corresponds to the "upstream pointing" end of the throttle plate 15. It will be appreciated that other embodiments of the biasing element 9 may have different physical dimensions to fit different throttle bodies and the locations and dimensions of the slots may also vary.

In one embodiment, each slot 7 may be 1.2 millimeters (mm) wide, 1.2 mm high, and 8 mm long. However, it will be appreciated that the dimensions of the slot 7 may vary with each application. For example, for a chamber, or air channel 55 having a 3 or 4 inch diameter, the above-listed dimensions for the slot 7 are effective, but for a chamber, or air channel 55 having a 6 or 8 inch diameter, the above-listed dimensions for the slot 7 may be changed. An embodiment for this diameter air channel 55 may size the slots 7 to create a flow of fuel that reaches 0.7 or 0.8 Mach speed to inject the fuel into the interior of the air channel 55. In this embodiment, the trip, or flange 45 may be removed to allow the fuel to be laminarly injected into the air channel 55. However, the energy imparted to the fuel by the high-speed configuration of the slots 7 causes the fuel to mix with the air in the air channel 55. Alternatively, the flange 45 may be removed only in sections, thereby causing the fuel to be laminarly injected into the air channel 55 is some areas, and turbulently injected into the air channel 55 in other areas.

Figure 5:
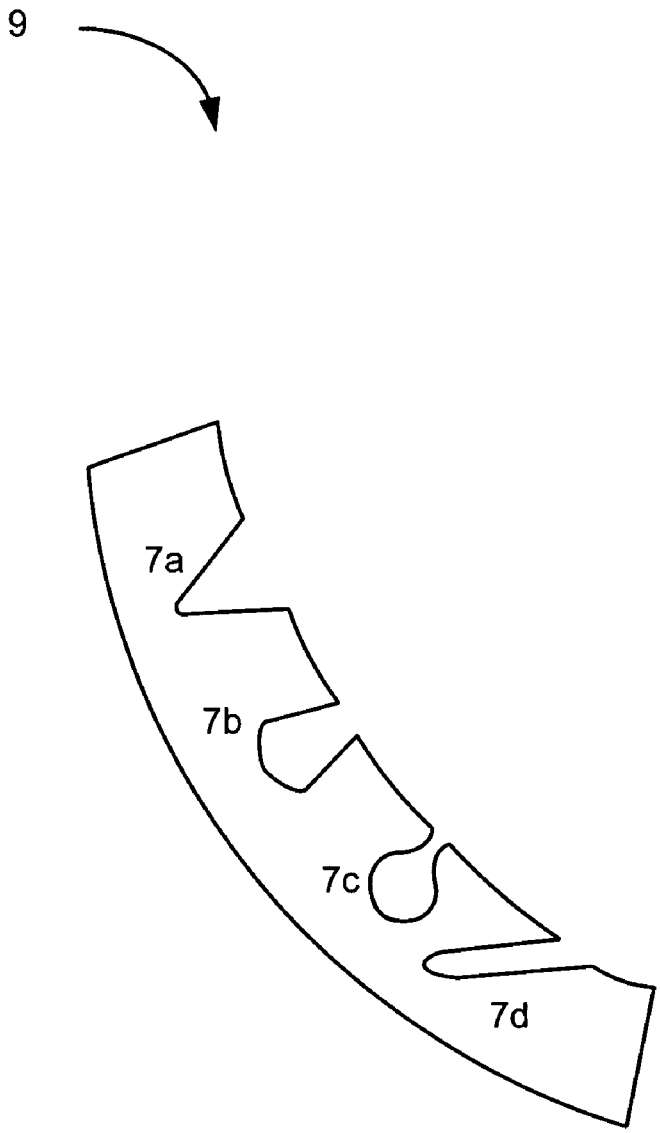
FIG. 5 is a plan view of a section of another embodiment of the biasing element illustrated in FIGS. 2 and 4, showing alternative embodiment fuel slots.

For example, as shown in FIG. 5, the slots 7 may also have different shapes to enhance the "nozzle" effect. That is, one feature of the biasing element 9 is that the slots 7, shown in FIGS. 2 and 4, act as nozzles to eject the fuel deep into the air channel 55, resulting in superior mixing of the fuel and air. Generally, the fuel is introduced into the air channel 55 at a pressure that is 5 pounds-per-square-inch (psi) above the pressure in the air channel 55. When the pressure of the fuel is twice that of the air pressure in the air channel 55, flow through the slots 7 can approach sonic speeds (i.e, Mach speeds), which results in violent, and effective mixing.

Referring now to FIG. 5, the shape of slots 7 may differ from that shown in FIGS. 2 and 4 that illustrate the slots 7 having straight sides, in a substantially rectangular shape. Specifically, the slot 7 may diverge 7*a*, converge 7*b*, or converge and then diverge 7*c*. These, and other shapes may be used to accelerate the gas to sonic (converging) or supersonic (converging-diverging) velocities to further enhance mixing with the air. Other shapes may also be employed, depending on the need to either penetrate fuel deep into the air channel 55, or to introduce fuel at other locations, or distances into the air channel 55. For example, angled slot 7*d* is used to create a "swirl" effect that causes the fuel to rotate as it enters the air channel 55. Swirl is important to mixing and combustion for engines that employ gaseous fuels. The use of slots 7 allows the fuel system designer to convert the pressure of the compressed natural gas (CNG) or hydrogen, into mixing energy and/or swirl energy as the fuel passes into the air channel 55 from the fuel canal 60.

Returning now to FIGS. 2 and 3, another feature of the fuel mixer 5 is illustrated. As the fuel passes through the port 50, around the fuel canal 60 and into slots 7 in biasing element 9, it is "tripped" by projection, or flange 45 before it enters the air channel 55. The flange 45 creates a laminar to turbulent flow trip point. In fluid dynamics, turbulence or turbulent flow is a flow regime characterized by low momentum diffusion, high momentum convection, and rapid variation of pressure and velocity. Flow that is not turbulent is called laminar flow.

Generally, the gas flow is mostly laminar as it approaches the flange 45, but upon contact with the flange 45, the gas flow is "tripped" causing it to tumble, swirl, and otherwise chaotically flow into the air chamber 55. This irregular movement of the fuel greatly improves mixing with the air. In the embodiment illustrated in FIG. 2, the flange 45 comprises a continuous ring substantially located at the inner diameter of the fuel mixer 5, adjacent to the perimeter of the air channel 55. However, in other embodiments, the flange 45 may have gaps, allowing some fuel to enter the air channel 55 in a laminar fashion.

Also, the dimension (height and/or width) of the flange 45 may vary, depending on the amount of desired mixing. For example, in one embodiment, the flange 45 may extend from the fuel canal 60 a sufficient amount to reduce the cross-sectional area of the fuel canal 60 by 10% to 12%. Other embodiments may increase or decrease this percent reduction in cross-sectional area.

Once the fuel is introduced into the air channel 55 it mixes with the air and enters the intake manifold 25 and then each cylinder's combustion chamber 35. Thus as described above, the fuel mixer 5 and biasing element 9 have several features that combine to generate vigorous mixing of the air and fuel in the air chamber 55, thereby enabling each different engine to have an ideal air-to-fuel ratio in every cylinder. These features are especially important on large engines that use large diameter throttle bodies, where adequate mixing of air and fuel is particularly difficult.

Thus, it is seen that an apparatus and method of introducing and mixing gaseous fuel and air for an internal combustion engine is provided. One skilled in the art will appreciate that the present invention can be practiced by other than the above-described embodiments, which are presented in this description for purposes of illustration and not of limitation. The specification and drawings are not intended to limit the exclusionary scope of this patent document. It is noted that various equivalents for the particular embodiments discussed in this description may practice the invention as well. That is, while the present invention has been described in conjunction with specific embodiments, it is evident that many alternatives, modifications, permutations and variations will become apparent to those of ordinary skill in the art in light of the foregoing description. Accordingly, it is intended that the present invention embrace all such alternatives, modifications and variations as fall within the scope of the appended claims. The fact that a product, process or method exhibits differences from one or more of the above-described exemplary embodiments does not mean that the product or process is outside the scope (literal scope and/or other legally-recognized scope) of the following claims.

What is claimed is:

1. An apparatus to deliver a fuel into a chamber, comprising:

a fuel inlet;

a substantially circular fuel distribution canal communicating with the fuel inlet;

a flange positioned in the substantially circular fuel canal, and directly adjacent to the chamber, the flange structured to perturb a fuel passing into the chamber; and a biasing element coupled to the substantially circular fuel distribution canal, the biasing element comprising a plurality of slots arranged to non-uniformly dispense the fuel into the chamber.

2. The apparatus of claim 1, where the flange is sized to reduce a cross-sectional area of the substantially circular fuel canal.

3. The apparatus of claim 1, where the plurality of slots are irregularly positioned about the biasing element.

4. The apparatus of claim 1, where the substantially circular fuel distribution canal is positionable about a perimeter of the chamber.

5. The apparatus of claim 1, where at least one of the plurality of slots is sized to increase in volume along a fuel path taken by the fuel as it is dispensed into the chamber.

6. The apparatus of claim 1, where at least one of the plurality of slots is sized to decrease in volume along a fuel path taken by the fuel as it is dispensed into the chamber.

7. The apparatus of claim 1, where at least one of the plurality of slots is sized to decrease and then increase in volume along a fuel path taken by the fuel as it is dispensed into the chamber.

8. An apparatus to deliver a fuel into a chamber, comprising:

a fuel inlet;

a substantially circular fuel canal communicating with the fuel inlet;

a flange positioned in the substantially circular fuel canal, and directly adjacent to the chamber, the flange structured to perturb a fuel passing into the chamber; and a biasing element coupled to the substantially circular fuel distribution canal, the biasing element comprising a plurality of slots arranged to non-uniformly dispense the fuel into the chamber.

9. The apparatus of claim 8, where the flange is sized to reduce a cross-sectional area of the substantially circular fuel canal.

10. The apparatus of claim 8, where the plurality of slots are irregularly positioned about the biasing element.

11. The apparatus of claim 8, where the substantially circular fuel distribution canal is positionable about a perimeter of the chamber.

12. The apparatus of claim 8, where at least one of the plurality of slots is sized to increase in volume along a fuel path taken by the fuel as it is dispensed into the chamber.

13. The apparatus of claim 8, where at least one of the plurality of slots is sized to decrease in volume along a fuel path taken by the fuel as it is dispensed into the chamber.

14. The apparatus of claim 8, where at least one of the plurality of slots is sized to decrease and then increase in volume along a fuel path taken by the fuel as it is dispensed into the chamber.

* * * * *